US008387536B2

(12) United States Patent
Sar et al.

(10) Patent No.: US 8,387,536 B2
(45) Date of Patent: Mar. 5, 2013

(54) INTERCEPTOR VEHICLE WITH EXTENDIBLE ARMS

(75) Inventors: David R. Sar, Corona, CA (US); Terry M. Sanderson, Tucson, AZ (US); Philip C. Theriault, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 1030 days.

(21) Appl. No.: 12/327,981

(22) Filed: Dec. 4, 2008

(65) Prior Publication Data

US 2012/0180691 A1 Jul. 19, 2012

(51) Int. Cl.
*F42B 8/00* (2006.01)

(52) U.S. Cl. ..... 102/400; 102/473; 102/501; 102/502

(58) Field of Classification Search ..... 102/400, 102/388, 500, 502, 504
See application file for complete search history.

(56) References Cited

U.S. PATENT DOCUMENTS

| | | | | |
|---|---|---|---|---|
| 2,559,827 | A | 7/1951 | Northrop | |
| 3,628,352 | A | 12/1971 | Stuemky | |
| 3,952,662 | A | 4/1976 | Greenlees | |
| 5,049,591 | A | 9/1991 | Hayashi et al. | |
| 5,082,207 | A | 1/1992 | Tulinius | |
| 5,181,678 | A | 1/1993 | Widnall et al. | |
| 5,194,030 | A * | 3/1993 | LeBoeuf et al. | 446/72 |
| 5,219,162 | A * | 6/1993 | Orbanes et al. | 473/571 |
| 5,662,294 | A | 9/1997 | Maclean et al. | |
| 6,264,136 | B1 | 7/2001 | Weston | |
| 6,705,568 | B2 | 3/2004 | Lee | |
| 6,834,835 | B1 * | 12/2004 | Knowles et al. | 244/198 |
| 7,728,267 | B2 * | 6/2010 | Sanderson et al. | 244/3.27 |
| 7,766,274 | B1 * | 8/2010 | Jameson et al. | 244/17.11 |
| 7,777,165 | B2 * | 8/2010 | Sanderson et al. | 244/3.27 |
| 7,832,690 | B1 * | 11/2010 | Levine et al. | 244/218 |
| 7,939,178 | B2 * | 5/2011 | Sar et al. | 428/591 |

(Continued)

FOREIGN PATENT DOCUMENTS

| | | |
|---|---|---|
| CN | 101028866 | 9/2007 |
| DE | 3116175 A1 | 11/1982 |

(Continued)

OTHER PUBLICATIONS

"A study on processing of composite metal foam via casting", A. Rabiei, A.T. O'Neill; Materials Science and Engineering A404 (2005) pp. 159-164. Jul. 25, 2005.*

(Continued)

*Primary Examiner* — Daniel J Troy
(74) *Attorney, Agent, or Firm* — Renner, Otto, Boisselle & Sklar, LLP

(57) ABSTRACT

A kinetic anti-projectile vehicle includes a body, and extendible arms that extend radially from the body. The arms include a foam material, such as a shape memory foam. The foam material may be heated to expand it. The foam arms may be mechanically restrained while being heated. The mechanically restraint may be removed by heating, for example including a fusible link or a shape memory sold material. The foam material arms may include solid material, either in the form of solid material particles, such as high strength particles, or in the form of supports or restraints in the foam material. The extension of the foam arms increases the effective area of the vehicle for impacting a projectile. Impact on the projectile from the body and/or one or more of the arms may be sufficient to destroy, divert, or otherwise disable the projectile.

16 Claims, 5 Drawing Sheets

U.S. PATENT DOCUMENTS

| | | | | |
|---|---|---|---|---|
| 8,016,249 | B2 * | 9/2011 | Sar et al. | 244/218 |
| 2002/0195177 | A1 | 12/2002 | Hinkley et al. | |
| 2003/0036090 | A1 | 2/2003 | Patil et al. | |
| 2003/0126978 | A1 | 7/2003 | Rastegar | |
| 2004/0086699 | A1 | 5/2004 | Schneider | |
| 2005/0157893 | A1 | 7/2005 | Pelrine et al. | |
| 2005/0206096 | A1 | 9/2005 | Browne et al. | |
| 2007/0107189 | A1 | 5/2007 | Prichard et al. | |
| 2008/0004686 | A1 * | 1/2008 | Hunt et al. | 623/1.11 |
| 2008/0061192 | A1 | 3/2008 | Sullivan | |
| 2009/0072094 | A1 | 3/2009 | Sanderson et al. | |
| 2009/0131959 | A1 * | 5/2009 | Rolland | 606/158 |
| 2009/0206192 | A1 | 8/2009 | Sanderson et al. | |
| 2009/0286101 | A1 | 11/2009 | Sar et al. | |
| 2010/0030308 | A1 | 2/2010 | Anderson et al. | |
| 2010/0282917 | A1 | 11/2010 | O'Shea | |
| 2010/0288870 | A1 * | 11/2010 | Geswender et al. | 244/3.27 |

FOREIGN PATENT DOCUMENTS

| | | | |
|---|---|---|---|
| EP | 0361418 | A2 | 4/1990 |
| EP | 0905019 | A2 | 3/1999 |
| EP | 1607602 | | 12/2005 |
| GB | 2445099 | | 6/2008 |
| JP | 60145385 | A | 7/1985 |
| JP | 2009047179 | A | 3/2009 |
| WO | 9308013 | A1 | 4/1993 |
| WO | 9324300 | A1 | 12/1993 |
| WO | 03068584 | | 8/2003 |
| WO | 2007001392 | | 1/2007 |
| WO | 2008068472 | A1 | 6/2008 |

OTHER PUBLICATIONS

"Shape Memory Polymer Characterization for Advanced Air Vehicle Technologies", Raytheon Technology Today, (2007), vol. 2007, No. 4, [retrieved from internet] <www.raytheon.com/technology_today/archive/2007_issue 4.pdf>.

Thill C. et al., "Morphing Skins", Aeronautical Journal, (2008), vol. 112, No. 1129, [retrieved from internet], <www.aer.bris.ac.uk/research/fibres/morph%20pics/RoyAeroSocMorphSkin.pdf>.

International Search Report and Written Opinion from corresponding International Application No. PCT/US09/54742.

Shaw, John A. et al., "The Manufacture of Niti Foams", Proceedings of 2002 ASME International Mechanical Engineering Congress and Exposition, (2002), pp. 1-10.

Perkins, David A. et al., "Morphing Wing Structures for Loitering Air Vehicles", 45th AIAA/ASME/ASCE/AHS/ASC Structures, Structural Dynamics & Materials Conference, (2004), pp. 1.

* cited by examiner

INTERCEPTOR VEHICLE WITH EXTENDIBLE ARMS

BACKGROUND OF THE INVENTION

1. Technical Field of the Invention

The invention is in the field of kinetic anti-projectile interceptor vehicles.

2. Description of the Related Art

Interceptors have been proposed to intercept and disable or destroy space-based or space-entering projectiles, for example ballistic projectiles such as intercontinental ballistic missiles. Such projectiles travel at very high rates of speed and have short travel times, making interception of them a difficult problem, one in which there is room for further improvements.

SUMMARY OF THE INVENTION

According to an aspect of the invention, a kinetic anti-projectile interceptor vehicle (kill vehicle) includes foam arms that extend from a body of the vehicle, to thereby increase the effective area for colliding with a projectile to be intercepted.

According to another aspect of the invention, a kinetic anti-projectile interceptor vehicle includes extendible foam arms that have solid material pieces in them.

According to yet another aspect of the invention, a kinetic anti-projectile interceptor vehicle includes extendible arms that include a shape memory foam.

According to still another aspect of the invention, a kinetic anti-projectile interceptor vehicle includes foam arms that are heated to extend them from a body of the vehicle.

According to a further aspect of the invention, a vehicle includes a body, and arms that are extendable from the body. Mechanical restraints hold the arms in place until the arms are extended.

According to a still further aspect of the invention, a method of intercepting a projectile includes heating foam arms to extend them radially from a body of an interceptor vehicle. Mechanical restraints may be used to hold the foam arms in a retracted condition while the foam arms are being heated. The heating may be electrical heating. Electrical heating may also be used to release the mechanical restraint. For example the mechanical restraint may include a fusible link.

According to another aspect of the invention, a kinetic interceptor vehicle includes: a body; and foam arms that are extendible radially outward from the body.

According to yet another aspect of the invention, a method of intercepting a projectile comprises: directing a kinetic anti-projectile interceptor vehicle toward the projectile; after the directing, deploying foam arms of the vehicle radially outward from a body of the vehicle; and after the deploying, impacting the projectile with at least one of the body or one or more of the foam arms.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

In the annexed drawings, which are not necessarily to scale.

DETAILED DESCRIPTION

A kinetic anti-projectile vehicle includes a body, and extendible arms that extend radially from the body. The arms include a foam material, such as a shape memory foam. The foam material may be heated to expand or deploy it, to return the foam material to its original or deployed shape from its packaged shape. The foam arms may be mechanically restrained whole being heated. An electrically-activated mechanism may be used to remove the mechanical restraint, to allow the arms to expand. The mechanical restraint may be removed by heating, for example including a fusible link or a shape memory material. The foam material arms may include solid material, either in the form of solid material particles, such as high strength particles, or in the form of supports or restraints in the foam material. The extension of the foam arms increases the effective area of the vehicle for impacting a projectile. Impact on the projectile from the body and/or one or more of the arms may be sufficient to destroy, divert, or otherwise disable the projectile.

Figure 1:
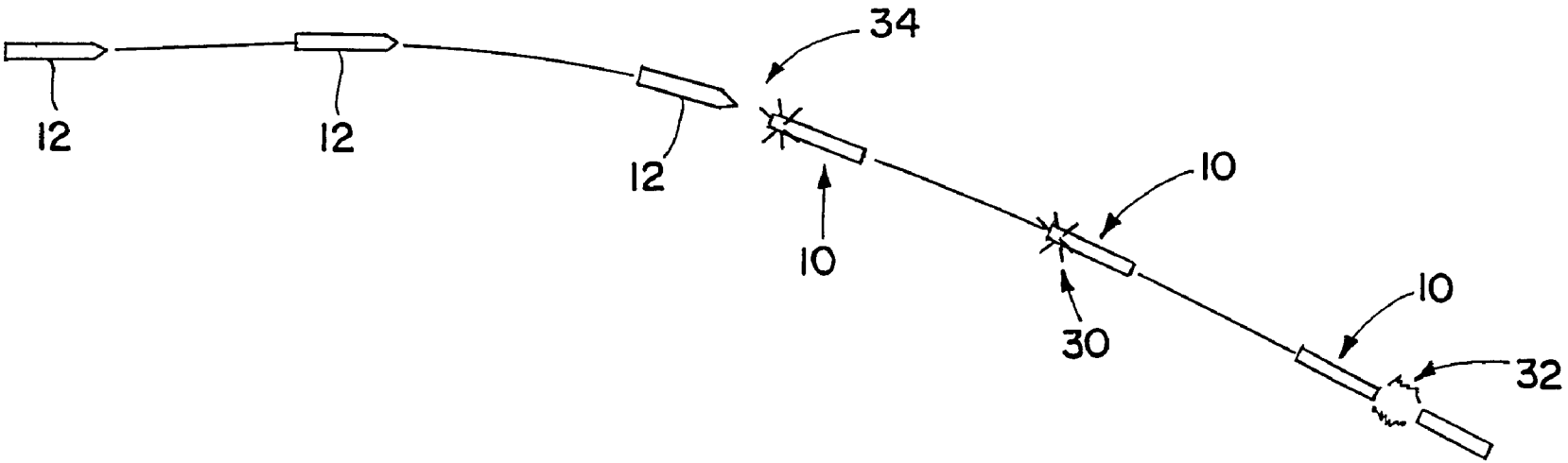
FIG. 1 is a schematic diagram showing use of interceptor vehicle according to an embodiment of the present invention, to intercept a projectile.

Referring initially to FIG. 1, a kinetic anti-projectile interceptor vehicle 10 is used to intercept and disable a projectile 12. The projectile 12 may travel on a ballistic trajectory and at a great speed, on the order of thousands of kilometers per hour. The vehicle 10 is directed toward the projectile 12. The vehicle 10 may be launched from a space platform or a surface platform, and may also travel at a great speed, on the order of thousands of kilometers per hour, such as at a speed of at least 16,000 to 48,000 km/hr (10,000 to 30,000 mph).

Figure 2:
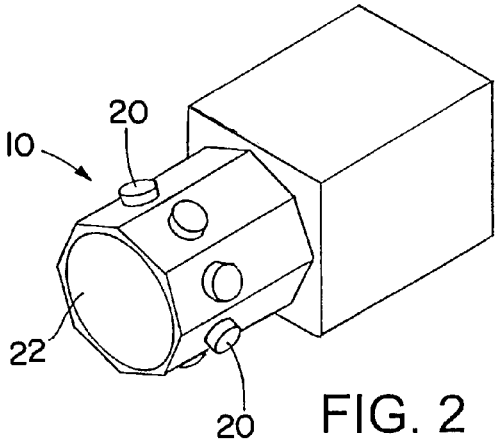
FIG. 2 is an oblique view of the interceptor vehicle of FIG. 1, with the arms in a retracted configuration.
Figure 3:
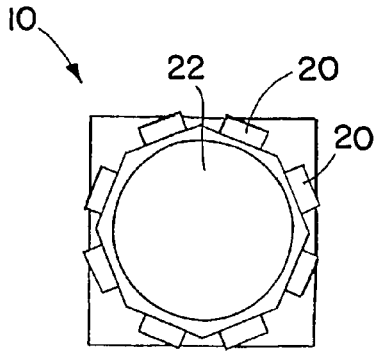
FIG. 3 is a front end view of the interceptor vehicle of FIG. 1, in the retracted configuration of FIG. 2.
Figure 4:
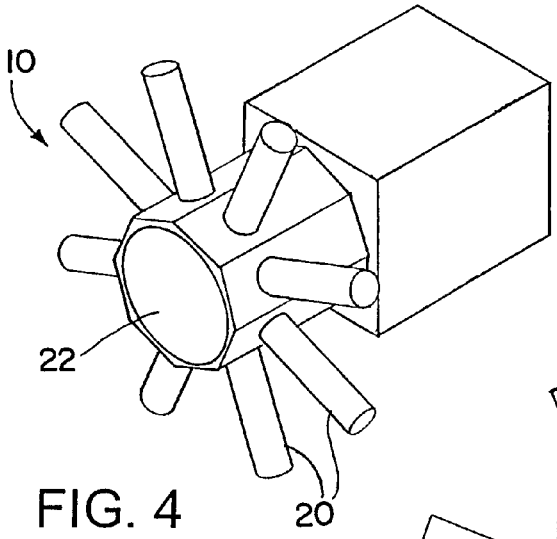
FIG. 4 is an oblique view of the interceptor vehicle of FIG. 1, with the arms in an extended or deployed configuration.
Figure 5:
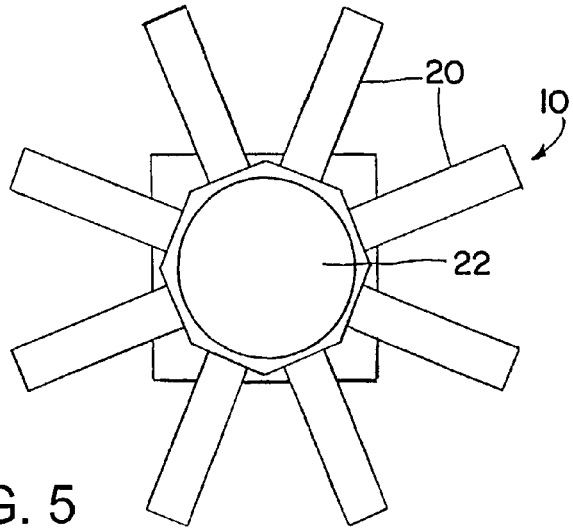
FIG. 5 is a front end view of the interceptor vehicle of FIG. 1, in the extended or deployed configuration of FIG. 4.

With reference now in addition to FIGS. 2-5, the vehicle 10 may reconfigure in flight, radially extending arms 20 from a central body 22 of the vehicle 10. FIGS. 2 and 3 show the vehicle 10 with the arms 20 in a retracted position or configuration, and FIGS. 3 and 4 show the vehicle 10 with the arms 20 in an extended or deployed configuration. The arms 20 may be axisymmetrically located about a longitudinal location on the central body 22 of the vehicle 10. The arms 20 may all be substantially identical in configuration. The arms 20 may be extended at a point 30 during the flight of the vehicle 10, after a launch 32 of the vehicle 10, but prior to an impact 34 between the vehicle 10 and the projectile 12. The extension of the arms 20 increases the likelihood of impact between the vehicle 10 and the projectile 12, by increasing the effective area over which the vehicle 10 may impact the projectile 12.

As explained in greater detail below, the arms 20 may include a foam material 26, such as a shape memory foam, that is heated in order to provide a force for shape change, in order to extend the arms 20 from the body 22. The heating may be performed by electrical heating of the foam material 26. The arms 20 may be mechanically restrained during the heating, in order that all of the arms 20 deploy at the same time. The mechanical restraints may involve solid material restraints within the foam material, and/or mechanisms that release with an electrical switch, such as through electrical heating and/or severing of a fusible link.

The arms 20 may be made of the foam material 26, such as shape memory polymer foam. The arms 20 may have pieces of solid material, such as a high-density metal or alloy in them, in order to provide greater kinetic energy when one or more of the arms 20 impact the projectile 12.

The arms 20 may have a diameter on the order of about 10 cm, and may have a length in their extended configuration on the order of meters. It will be appreciated that the arms 20 require no additional structural support when included on a space vehicle, as there are no gravity effects or wind resistance to distort their shapes.

In the following discussion first a general overview is given of the steps of a deployment process for deploying the arms 20. Then a schematic block diagram is given as an overview of the parts of the vehicle 10 used in deploying the arms 20. Finally several embodiments are discussed for the configuration of the arms 20 and for parts used in the deployment and configuration of the arms 20. It will be appreciated that the specific embodiments discussed are only examples of a wide variety of possible configuration of the arms 20 and the structures used in deploying the arms 20. The various embodiments may be discussed below only with regard to certain notable details, and it should be appreciated that details from the various embodiments may be combined, where appropriate, with those of other embodiments of the invention.

Figure 6:
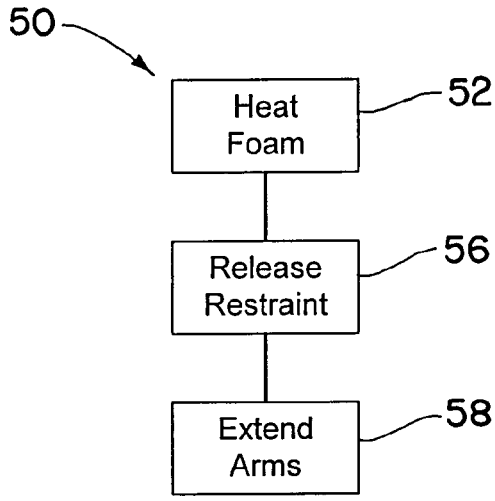
FIG. 6 is a high-level flow chart showing steps in a method of deployment of the arms of the interceptor vehicle of FIG. 1.

FIG. 6 shows some steps of a method 50 for deploying the arms 20. In step 52 the foam material 26 of the arms 20 is heated. As noted above, the foam material 26 may be a shape memory foam material. Shape memory materials have the property of returning to a certain previous shape when heated above a transition temperature. The shape that the shape memory returns to may be set by heating the material to an even higher temperature, then cooling the material while it is in a desired shape. Shape memory foam has a desirable characteristic of being able to revert to a desired shape even after long storage. Such polymer foam does not permanently conform to a shape that it is compressed into. The shape memory polymer foam therefore may be stored for a long period of time without losing its ability to extend to produce the extended arms 20 shown in FIGS. 4 and 5.

The heating may be electric heating of the foam material 26. Electric current may be passed through foam material itself, or through electrically conductive resistive heaters or other elements, such as wires, that are located within the foam material 26. The heating of shape memory foam material causes the material to produce a force to move it toward its "remembered" shape. This may involve an increase of at least 300% in a dimension of the arms 20, for example lengthening the arms 20 by a factor of four or more (a strain of at least 300%). Heating of foam that is not shape memory foam may soften the foam, making it easier to expand.

It will be appreciated that the shape memory polymer foam would expand during the heating unless it was restrained during the heating process. It is desirable that the shape memory polymer foam be restrained during heating in order to prevent the arms 20 from deploying prematurely. Premature deployment while heating would have the potential to deploy different of the arms 20 at different rates. Such asymmetric deployment could cause unwanted course changes to the vehicle 10, due to the change of location of the center of mass of the vehicle 10. Therefore in step 56, after the heating of the foam material 26 in preparation for extending the arms 20, mechanical restraint on the foam material 56 is released. This allows the arms 20 to extend in step 58, putting the vehicle 10 into the arms deployed or extended configuration shown in FIGS. 4 and 5. The mechanical restraint systems may have any of a wide variety of forms, only some of which are discussed below.

The release of the mechanical restraint may be an electrically-actuated or electro-optically-actuated release mechanism (which together are referred to herein as an electrically-actuated release mechanism, or simply a release mechanism). As one example, the electrically-actuated release mechanism may involve electrical heating of a fusible link to sever the link to release the mechanical restraint. The electrically-actuated release mechanism may involve use of a shape memory solid material, such as a shape memory alloy, that reverts to a previous shape upon electrical heating. Such a shape memory material element may be embedded in the foam material 26, and may serve as a heating element for heating the foam material. In one embodiment the shape memory material solid element may be subjected a relatively small current to provide heat for heating up the foam material, and then a sudden increase or burst of electric current to cause heating of the shape memory alloy solid material above a transition temperature that results in it producing forces tending to put it back into a previous (memory) shape. Other possible electrically-actuated release mechanisms include cutters driven by a pressurized gas and actuated electrically, for severing some part of a mechanical restraint, and explosive bolts.

Figure 7:
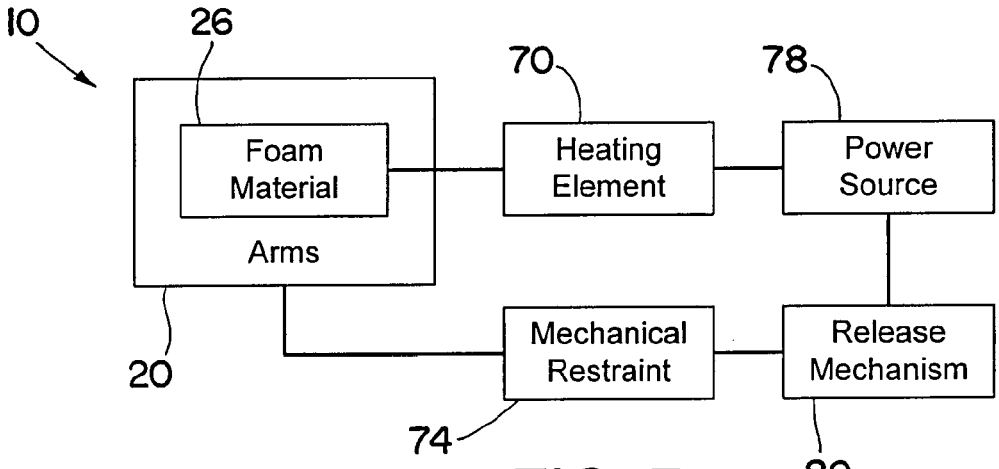
FIG. 7 is a schematic diagram of some systems of the interceptor vehicle FIG. 1.

FIG. 7 shows a schematic diagram of the vehicle 10, showing in block diagram form parts of the vehicle 10 related to the deployment of the arms 20. The foam material 26 of the arms 20 are operatively coupled to a heating element 70 for heating the foam material 26 (FIG. 4) of the arms 20, and a mechanical restraint system 74 for holding the foam material 26 in place during the heating. Although shown separately in the figure, the heating element 70 and/or the restraint system 74 may be part of the arms 20, for example embedded in the foam material 26. The heating element 70 is coupled to an electric power source 78, such as batteries, to provide electrical power for electrically heating the foam material 26. As discussed already, the heating element 70 may be placed or embedded in the foam material 26. Alternatively or in addition the heating element 70 and the restraint system 74 may be the same element, with for example a shape memory alloy solid material element being embedded in the foam material 26 to serve both as a heating element and as a restraint preventing premature extension of the foam material 26.

A release mechanism 80 is coupled to the mechanically restraint system 74 to release the mechanical restraint 74 after the heating has been completed, or at another time when extension of the arms 20 is desired. The release mechanism 80 may be an electrically-actuated release mechanism that is coupled to the power source 78 for its operation. Alternatively the release mechanism 80 may have a separate power source. The release mechanism may be a part of the mechanical restraint 74, such as a fusible link. The release of the mechanical restraint 74 may allow the foam material 26 to extend under its own forces, such as forces from a shape memory polymer foam that has been heated above a transition temperature. The release may also cause an element within or coupled to the foam arms to provide a force to extend the arms 20.

Figure 8:
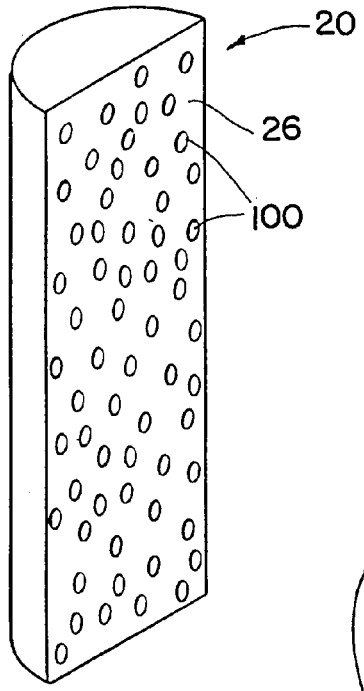
FIG. 8 is a sectional view of one of the arms of the interceptor vehicle of FIG. 1, showing solid material pieces embedded in the foam material of the arm.

FIG. 8 shows one of the arms 20, with solid material pieces 100 interspersed within the foam material 26. The solid pieces 100 are used to provide inertia to divert or destroy the projectile 12 (FIG. 1) when one or more of the arms 20 impact the projectile 12. The pieces 100 may be substantially uniformly dispersed within the foam material 26, and/or may be randomly dispersed within the foam material 26. The pieces, members, or chunks 100 may be spherical, and may have any of a variety of sizes, for example having diameters anywhere in a range of 2-10 mm, or more narrowly about 1 cm in diameter. The solid material pieces 100 may be made of any of a variety of dense materials, including one or more of tungsten-carbide, tungsten, depleted uranium, stainless steel or other types of steel, or copper. Even though the solid material pieces or chunks 100 may be small, they may have sufficient inertia when travelling at a very high speed (for instance the speeds in excess of 16,000 km/hour cited above) to divert, destroy, or otherwise negatively affect the projectile 12 that the arm 20 collides with.

Figure 10:
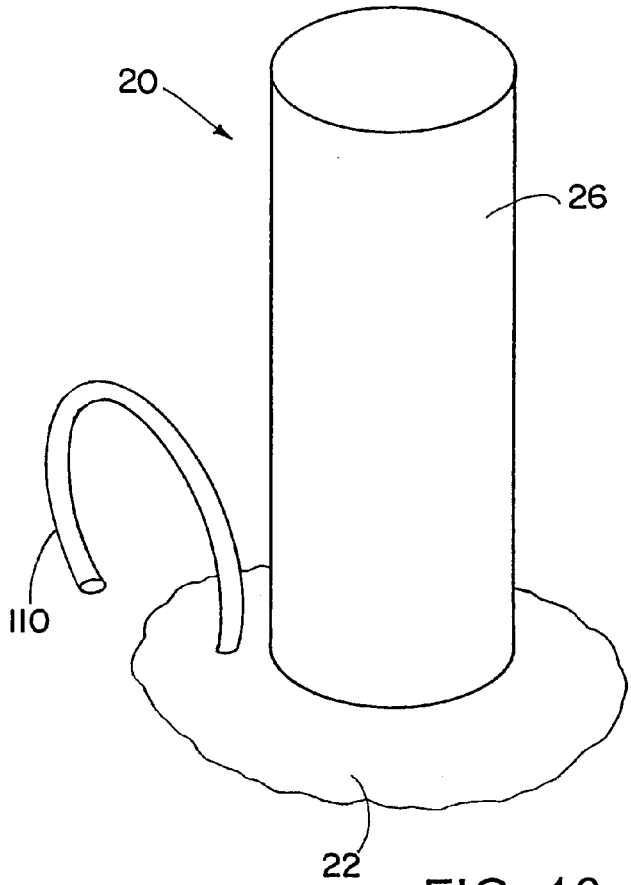
FIG. 10 is an oblique view illustrating release of the mechanical restraint of FIG. 9.
Figure 9:
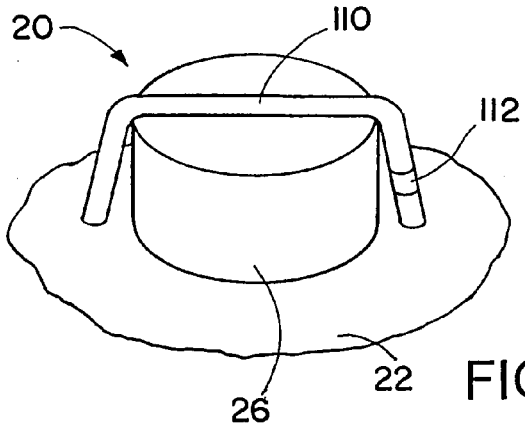
FIG. 9 is an oblique view illustrating a first embodiment mechanical restraint usable as part of the interceptor vehicle of FIG. 1.

FIGS. 9 and 10 shows one type of mechanical restraint, a strap 110 which restrains the foam material 26 of an arm 20, as shown in FIG. 9. The strap 110 may be made of a suitable metal, and may include a fusible link 112 that may be severed by electric heating. The fusible link 112 may be made of a metal with a relatively low melting point or softening temperature, for example lead or alloys associated with solder. A sudden burst of electrical energy may be applied to run a current through the fusible link 112 to heat the material of the fusible link. As shown in FIG. 10, this causes the strap 110 to break at the fusible link 112, releasing the foam material 26 of the arm 20 to expand.

It will be appreciated that the strap 110 may not have to have great strength to contain the foam material 26 during heating, as shape memory foam material may produce only small forces, albeit forces sufficient to extend the arm 26. It will also be appreciated that other mechanisms may be used for severing and releasing a strap, such as a cutting mechanism like a pressure-driven cutter. It will further be appreciated that it is possible for the strap 110 to serve as a heater for heating the foam material 26 while still restraining the foam material 26, as long as the electric current passed through the strap 110 does not result in heating that will soften or melt the fusible link 112.

Figure 11:
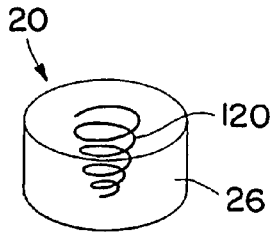
FIG. 11 is an oblique view illustrating a second embodiment mechanical restraint usable as part of the interceptor vehicle of FIG. 1.
Figure 12:
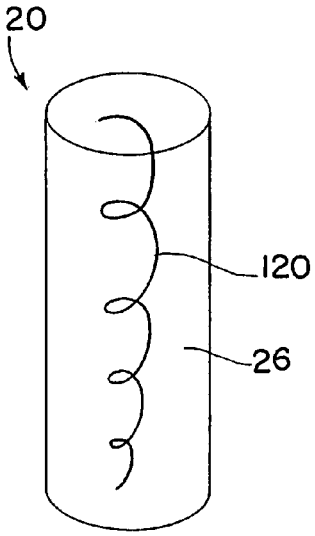
FIG. 12 is an oblique view illustrating release of the mechanical restraint of FIG. 11.

FIGS. 11 and 12 show another type of mechanical restraint, a shape memory alloy solid member or element 120 that is embedded in the foam material 26 of the arm 20. In the illustrated embodiment the shape memory alloy structure or element 120 is coiled while restraining the foam material, as shown in FIG. 11. However it will be appreciated that a shape memory alloy member may have any of a wide variety of shapes and configurations for restraining expansion of a foam material.

The shape memory alloy member 120 may be used as a heater for heating the foam material 26 while the foam material is restrained. A relatively low current may be passed through the shape memory alloy member 120, sufficient for heating the surrounding foam material 26, but not so much as to trigger the shape memory properties of the member 120. When extension of the arm 20 is desired, an increased electrical current may be passed through the shape memory alloy member 120. This heating would be sufficient to trigger the shape memory properties of the member 120, causing the member 120 to revert to a previous shape consistent with extension of the arm 20, as shown in FIG. 12. It will be appreciated that the characteristics of the foam material 26 and the member 120 may be such that the shape memory characteristics of the foam material 26 are triggered at a lower temperature than the shape memory characteristics of the member 120.

Figure 13:
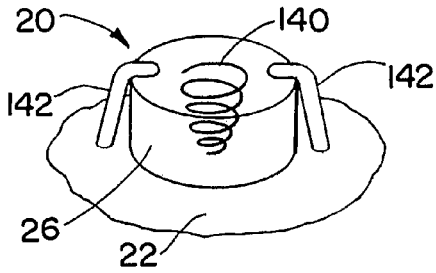
FIG. 13 is an oblique view illustrating a third embodiment mechanical restraint usable as part of the interceptor vehicle of FIG. 1.
Figure 14:
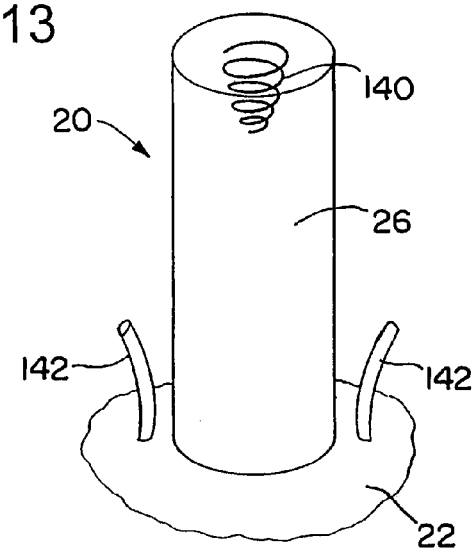
FIG. 14 is an oblique view illustrating release of the mechanical restraint of FIG. 13.

FIGS. 13 and 14 show still another type of mechanical restraint, a spring 140 which is shown in FIG. 13 as restraining the foam material 26 of the arm 20. The spring 140 may be a coil spring held in its compressed state by a pair of straps or ties 142 that may hold the various coil of the spring 140 together, and may tie the spring 140 to the body 22 of the vehicle. The straps 142 may be made of a fusible material that may be electrically heated to sever the straps or ties 142 to allow extension of the foam material, as shown in FIG. 14. Like the shape memory alloy member 120 (FIG. 9), the spring 140 may aid in providing force on the foam material 26 to extend the arms 20. It will be appreciated that the spring 140 may be embedded in only part of the foam material 26.

Figure 15:
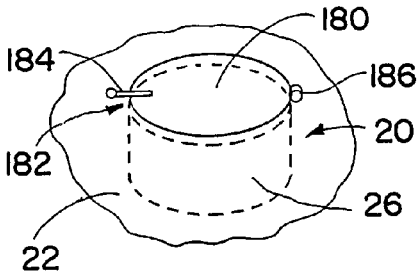
FIG. 15 is an oblique view illustrating a first embodiment mechanical restraint usable as part of the interceptor vehicle of FIG. 1.
Figure 16:
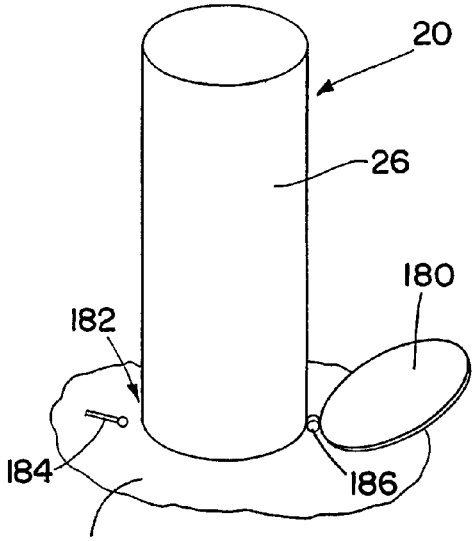
FIG. 16 is an oblique view illustrating release of the mechanical restraint of FIG. 14.

FIGS. 15 and 16 show another type of mechanical restraint, a covering 180 over an opening 182 in the vehicle body 22 through which the arm 20 emerges. The covering or trap door 180 may be held closed by a fusible or mechanically severable wire 184 during heating of the foam material, as illustrated in FIG. 15. A spring 186 may aid in rapidly opening the covering 180 when the wire 184 is melted or severed, allowing the arms to extend, as shown in FIG. 16.

It will be appreciated that many other types of mechanical restraint systems and configurations of mechanical restraint systems are possible.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A kinetic interceptor vehicle comprising:

a body;

foam arms that are extendible radially outward from the body;

an electrical power source operatively coupled to the foam arms to heat the foam arms prior to the extension of the foam arms; and a mechanical restraint to mechanically restrain the foam arms in a retracted configuration during the heating;

wherein the foam arms extend by increasing their radial extent, without changing orientation of the foam arms relative to the body;

wherein the foam arms include at least four arms; and wherein the foam arms include a shape memory foam.

2. The interceptor vehicle of claim 1, wherein the mechanical restraint includes solid material elements in the foam arms that restrain movement of the foam while the foam is being heated.

3. The interceptor vehicle of claim 2, wherein the solid material elements includes a shape memory alloy material that changes shape upon heating, to allow the foam arms to extend.

4. The interceptor vehicle of claim 1, wherein the mechanical restraint includes solid material elements that restrain movement of the foam while the foam is being heated; and wherein the solid material elements each include a fusible link that at least softens upon heating, to allow the foam arms to extend.

5. The interceptor vehicle of claim 1, wherein the mechanical restraint includes respective springs in foam material of the arms that maintain the arms in a compressed configuration during heating.

6. The interceptor vehicle of claim 5, wherein at least part of the springs is made of a shape memory alloy solid material.

7. The interceptor vehicle of claim 1, wherein the mechanical restraint is selectively activated by applying electric power to heat the mechanical restraint.

8. The interceptor vehicle of claim 1, wherein the mechanical restraint includes an electrically activated release mechanism for releasing the arms.

9. The interceptor vehicle of claim 1, wherein the foam arms have pieces of solid material embedded therein, to provide additional momentum striking a projectile intercepted by the arms.

10. The interceptor vehicle of claim 9, wherein the solid material pieces are metal pieces.

11. The interceptor vehicle of claim 9, wherein the solid material pieces are substantially spherical pieces having a diameter of from 2 to 10 mm.

12. The interceptor vehicle of claim 9, wherein the solid material pieces have a density at least that of steel.

13. The interceptor vehicle of claim 1, wherein foam material of the arms extends in length as the arms are moved from a retracted configuration to an extended configuration.

14. The interceptor vehicle of claim 13, wherein the foam material extends in length at least 300% as the arms are moved from a retracted configuration to an extended configuration.

15. The interceptor vehicle of claim 1, wherein for each of the arms the foam is continuous from a radially inward end of the arm to an outward end of the arm.

16. The interceptor vehicle of claim 1, wherein the arms are axisymmetric around the body.

* * * * *